US007637850B2

(12) United States Patent
Chen

(10) Patent No.: US 7,637,850 B2
(45) Date of Patent: Dec. 29, 2009

(54) TREADMILL HAVING ADJUSTABLE CONTROL PANEL

(75) Inventor: Ming Nan Chen, Taichung Hsien (TW)

(73) Assignee: Michael Lin, Chongsan Chu, Taipei (TW)

( * ) Notice: Subject to any disclaimer, the term of this patent is extended or adjusted under 35 U.S.C. 154(b) by 80 days.

(21) Appl. No.: 12/152,059

(22) Filed: May 12, 2008

(65) Prior Publication Data

US 2009/0280964 A1 Nov. 12, 2009

(51) Int. Cl.
*A63B 22/02* (2006.01)
*A63B 22/00* (2006.01)

(52) U.S. Cl. ..... 482/54

(58) Field of Classification Search ..... 482/51–54, 482/57–65, 148
See application file for complete search history.

(56) References Cited

U.S. PATENT DOCUMENTS

| | | | | | |
|---|---|---|---|---|---|
| 4,544,081 | A * | 10/1985 | Voegeli | 221/155 |
| 5,676,624 | A | 10/1997 | Watterson et al. | 482/54 |
| 5,833,577 | A * | 11/1998 | Hurt | 482/54 |
| 6,077,200 | A | 6/2000 | Lin | 482/54 |
| 6,110,076 | A * | 8/2000 | Hurt | 482/54 |
| 6,241,638 | B1 * | 6/2001 | Hurt | 482/54 |
| 6,350,218 | B1 * | 2/2002 | Dalebout et al. | 482/54 |
| 6,682,460 | B2 * | 1/2004 | Lo et al. | 482/54 |
| 6,705,973 | B1 * | 3/2004 | Fon | 482/8 |
| 6,716,142 | B2 | 4/2004 | Kuo | 482/54 |
| 6,811,519 | B2 | 11/2004 | Kuo | 482/54 |
| 7,192,388 | B2 * | 3/2007 | Dalebout et al. | 482/54 |
| 2007/0225120 | A1 * | 9/2007 | Schenk | 482/4 |
| 2008/0242511 | A1 * | 10/2008 | Munoz et al. | 482/5 |
| 2009/0062072 | A1 * | 3/2009 | Packham | 482/4 |

* cited by examiner

*Primary Examiner*—Steve R Crow
(74) *Attorney, Agent, or Firm*—Charles E. Baxley

(57) ABSTRACT

A treadmill includes a support device disposed on a tread base, a handle device having two arms pivotally attached to the support device with an axle and rotatable between a working position and a storing position, and a control device disposed between the arms. The control device may include a frame pivotally attached to the arms with a pivot shaft for allowing the frame to be pivoted relative to the arms of the handle device. The control device includes a groove formed in a flap, and the support device includes a guide rod slidably engaged into the groove of the flap for guiding the frame to pivot relative to the support device and for limiting the frame to rotate relative to the support device.

10 Claims, 8 Drawing Sheets

TREADMILL HAVING ADJUSTABLE CONTROL PANEL

BACKGROUND OF THE INVENTION

1. Field of the Invention

The present invention relates to a treadmill, and more particularly to a treadmill including a control console or control panel or control device pivotally or adjustably attached to or disposed on a front support structure with a handle device and tiltable or adjustable relative to the front support structure to any required angular position.

2. Description of the Prior Art

Typical treadmills comprise a tread base including an endless belt rotatably attached to or disposed on the tread base, and a front support structure or handle device pivotally or adjustably attached to or disposed on the tread base for supporting the upper portions of the users, and for supporting a control console or control panel or control device.

For example, U.S. Pat. No. 5,676,624 to Watterson et al. discloses one of the typical treadmills comprising a tread base rotatably attached to a front support structure which is provided for supporting a control console or control panel or control device on top of the front support structure.

However, the control console or control panel or control device is normally solidly and fixedly attached or disposed or secured on top of the front support structure, and may not be tilted or adjusted relative to the front support structure to the other required angular positions such that some of the users, such as children may not suitably see or watch the control console or control panel or control device particularly while jogging or running on the endless belt of the tread base.

U.S. Pat. No. 6,077,200 to the present inventor, Lin discloses another typical treadmill comprising a handle device and a stay pivotally coupled together, and a tread base rotatably attached to the stay and/or the handle device, in which the handle device may be provided for supporting a control console or control panel or control device.

However, similarly, the control console or control panel or control device is also solidly and fixedly attached or disposed or secured on top of the handle device, and may not be tilted or adjusted relative to the handle device to the other required angular positions such that some of the users, such as children may not suitably see or watch the control console or control panel or control device particularly while jogging or running on the endless belt of the tread base.

U.S. Pat. No. 6,716,142 to Kuo, and U.S. Pat. No. 6,811,519 to Kuo disclose two further typical treadmills each comprising a handle device or two handles solidly and fixedly attached or disposed or secured on top of the tread base and provided for supporting a control console or control panel or control device.

However, similarly, the control consoles or control panels or control devices are also solidly and fixedly attached or disposed or secured on top of the handle device, and may not be tilted or adjusted relative to the handle device to the other required angular positions such that some of the users, such as children may not suitably see or watch the control console or control panel or control device particularly while jogging or running on the endless belt of the tread base.

The present invention has arisen to mitigate and/or obviate the afore-described disadvantages of the conventional control panels for the treadmills.

SUMMARY OF THE INVENTION

The primary objective of the present invention is to provide a treadmill including a control console or control panel or control device pivotally or adjustably attached to or disposed on a front support structure with a handle device and tiltable or adjustable relative to the front support structure to any required angular position.

In accordance with one aspect of the invention, there is provided a treadmill comprising a tread base, a support device disposed on the tread base, a handle device including two arms pivotally attached to the support device with an axle for allowing the handle device to be pivoted relative to the support device between a working position and a storing position, and a control device disposed between the arms and tiltable relative to the support device for being easily seen by the users.

The control device includes a frame pivotally attached to the arms with a pivot shaft for allowing the frame to be pivoted relative to the arms of the handle device.

The control device includes a flap attached to the frame and having a groove formed in the flap, and the support device includes a guide rod slidably engaged into the groove of the flap for guiding the frame to pivot relative to the support device.

The support device includes two beams, and the guide rod is disposed one of the beams. The support device includes a gasket disposed between the arm and the beam.

The handle device includes a curved slot formed in one of the arms and formed around the axle, and the support device includes a guide pin slidably engaged into the curved slot of the arm for guiding the arm to pivot relative to the beam and for limiting the arm to pivot relative to the beam. The guide pin is disposed one of the beams.

The handle device includes a curved slot formed in one of the arms and formed around the axle, and the support device includes a latch device slidably engaged with the curved slot of the arm for adjustably latching the arm to the support device at selected angular positions.

The arm includes an enlarged opening formed in one end of the curved slot and having an inner diameter greater than that of the curved slot of the arm, the latch device includes a latch member having an outer diameter greater than the inner diameter of the curved slot of the arm but no greater than the inner diameter of the opening of the arm for allowing the latch member to be engaged into the opening of the arm and for latching the arm to the handle device.

The latch device includes a casing attached to one of the beams, a button slidably engaged in the casing and secured to the latch member, and means for biasing the latch member to engage into the opening of the arm.

The support device includes a gasket disposed between the arm and the beam. The handle device includes a hand grip secured between the arms for forming a substantially rectangular and stable structure for the handle device and for being grasped or held by the users.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
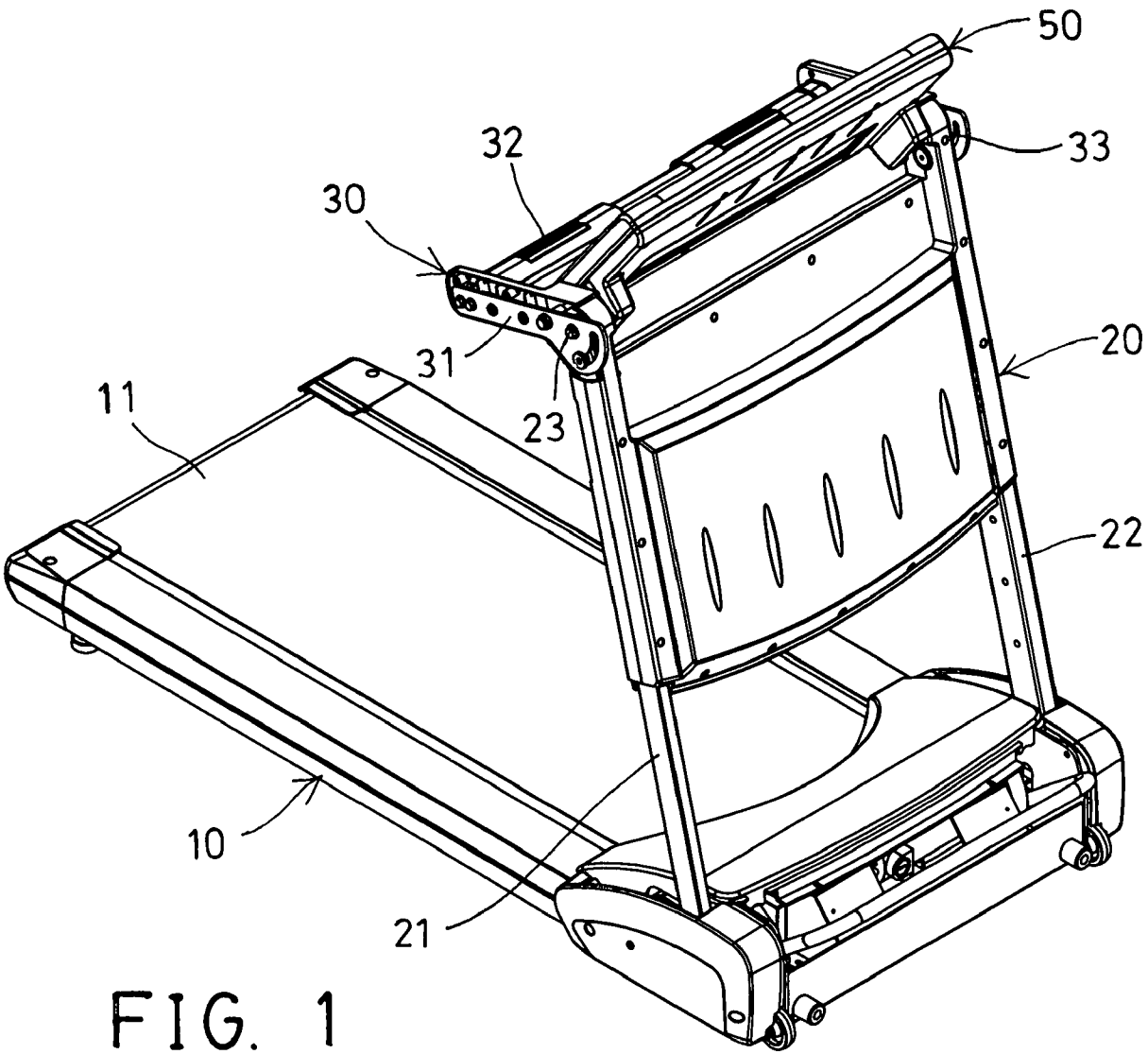
FIG. 1 is a perspective view of a treadmill in accordance with the present invention, in which the treadmill is unfolded or positioned to an unfolding or open or working position.
Figure 2:
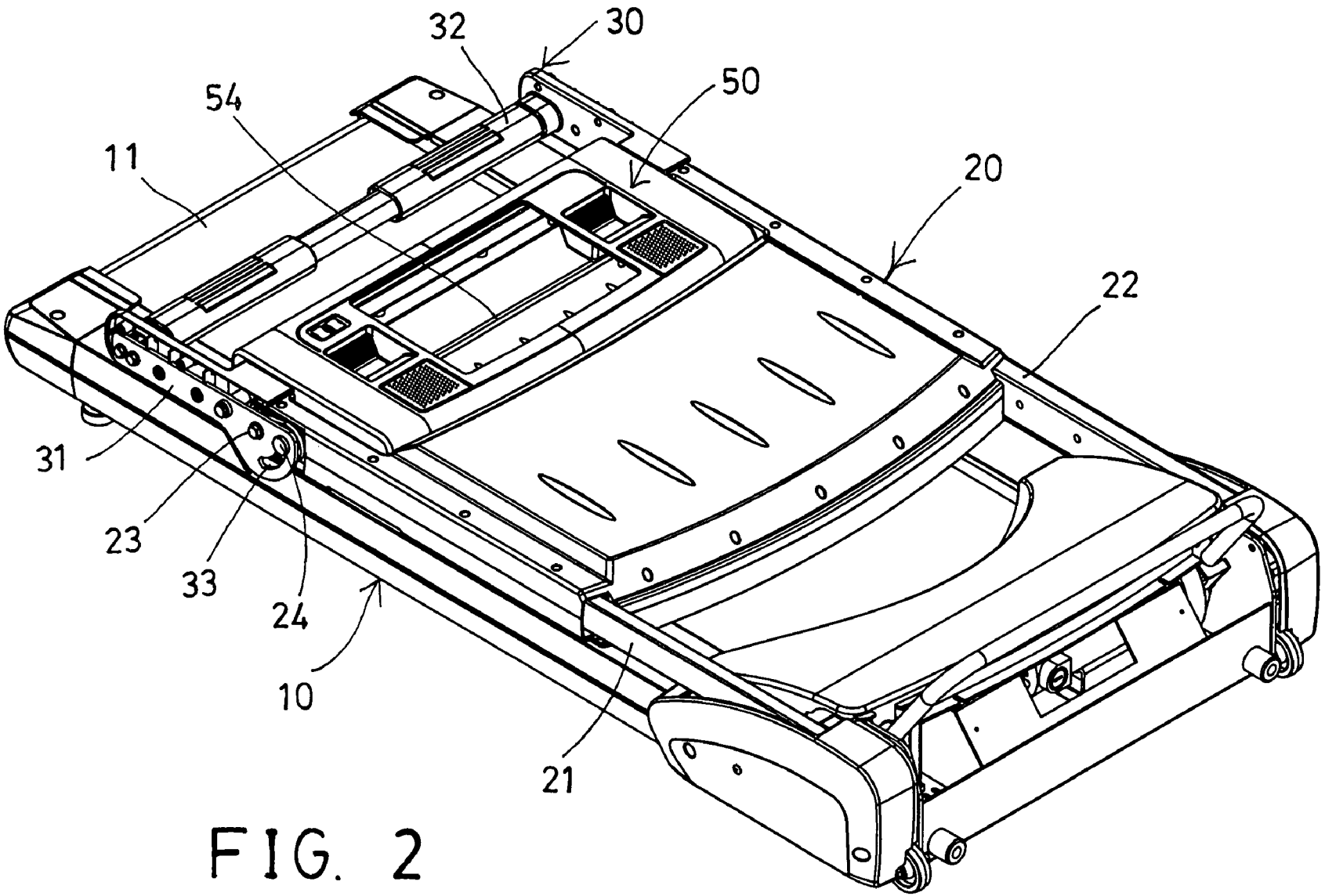
FIG. 2 is a perspective view of the treadmill, in which the treadmill is folded or positioned to a folding or close or storing position.

Referring to the drawings, and initially to FIGS. 1 and 2, a treadmill in accordance with the present invention comprises a tread base 10 including an endless belt 11 rotatably attached to or disposed on the tread base 10 for supporting a user and for allowing the user to conduct the jogging or running exercises, and a front support structure or device 20 pivotally or adjustably attached to or provided or disposed on the tread base 10 for supporting the upper portions of the users, and for supporting a control console or control device 50 with a pivotal attachment or handle device 30. The support device 20 includes two beams 21, 22 disposed or arranged parallel to each other for supporting the control device 50 and the handle device 30 on top of the support device 20.

Figure 9:
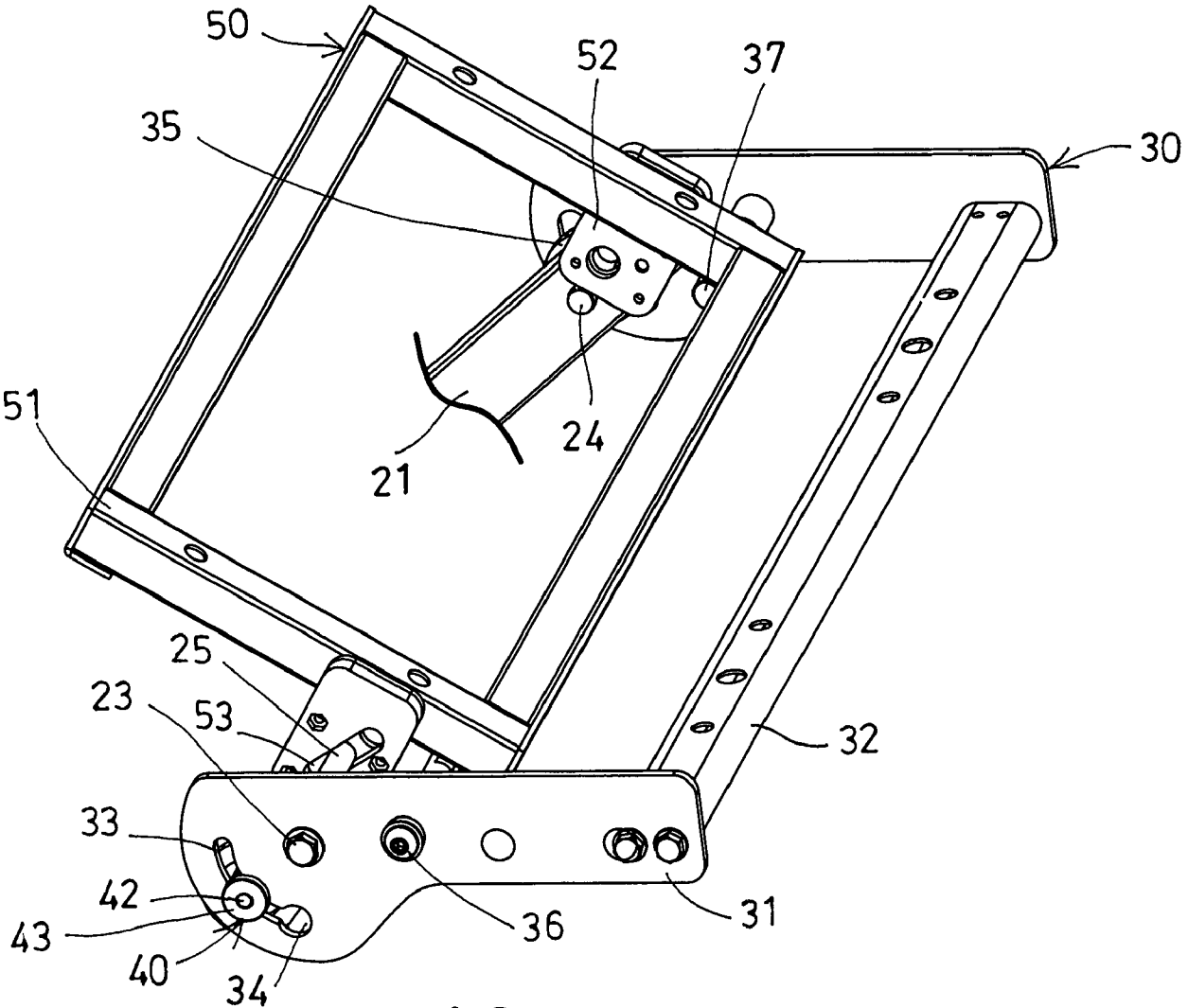
FIGS. 9, 10 are enlarged partial perspective views illustrating the operation of the treadmill.
Figure 10:
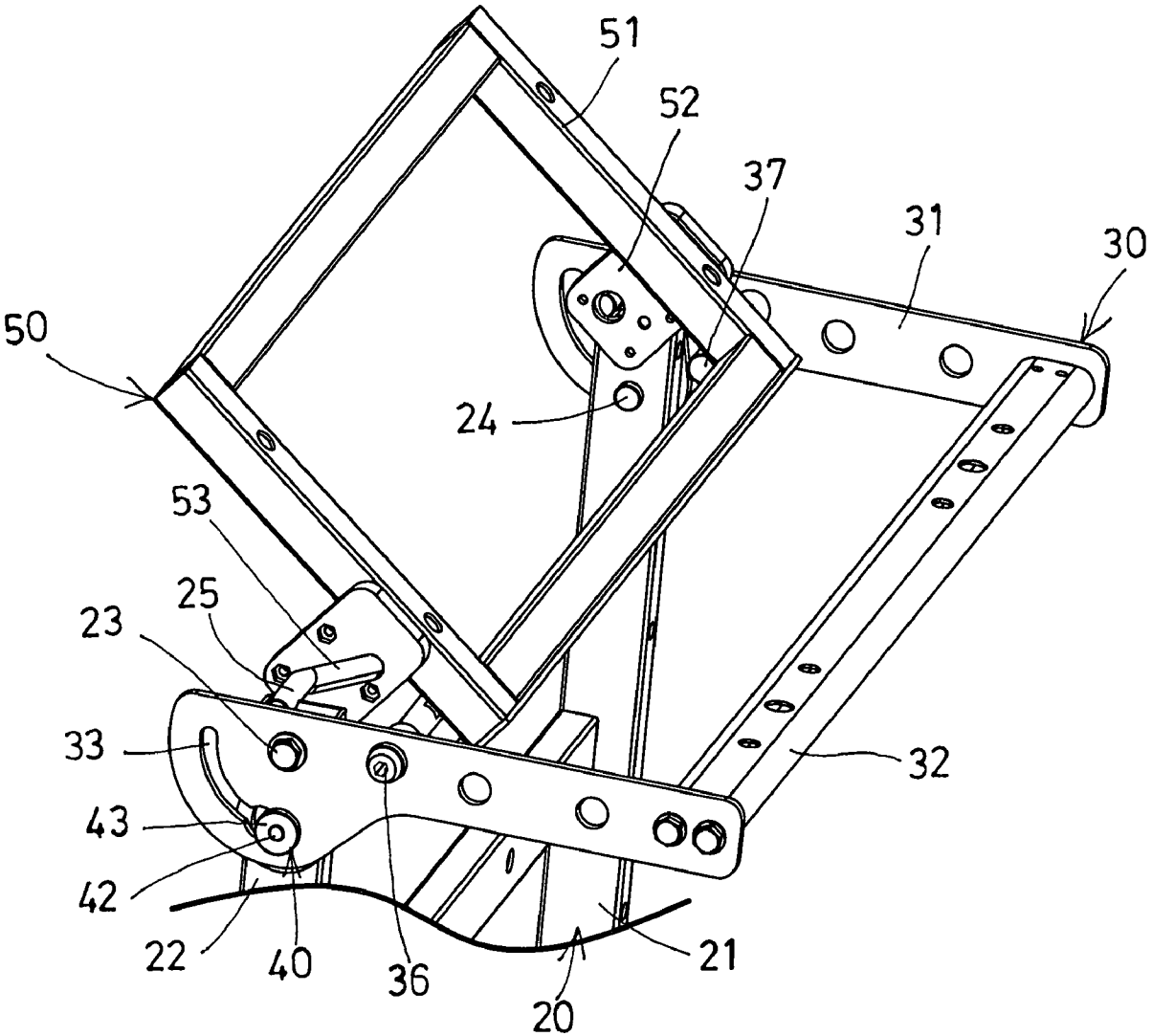

The handle device 30 includes two arms 31 pivotally or rotatably attached to the beams 21, 22 of the support device 20 with an axle 23 for allowing the handle device 30 to be pivoted or rotated relative to the beams 21, 22 of the support device 20 between the unfolding or open or working position as shown in FIG. 1 and the folding or close or storing position as shown in FIG. 2, and includes a hand grip 32 attached or disposed or secured between the arms 31 for forming a substantially rectangular and stable structure for the handle device 30 and for being grasped or held by the users, and includes a curved slot 33 formed in each arm 31 and formed around the axle 23, and includes an enlarged opening 34 formed in one end of the curved slot 33 of each arm 31 (FIGS. 6, 9) and having an inner diameter greater than that of the curved slot 33 of the respective arm 31.

Figure 4:
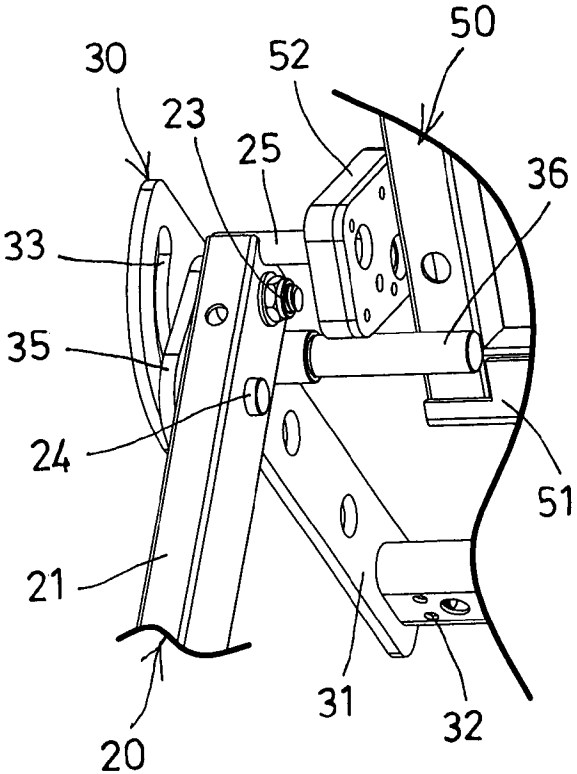
FIGS. 3, 4 are enlarged partial perspective views illustrating one side portion of the control console or control panel or control device for the treadmill.
Figure 3:
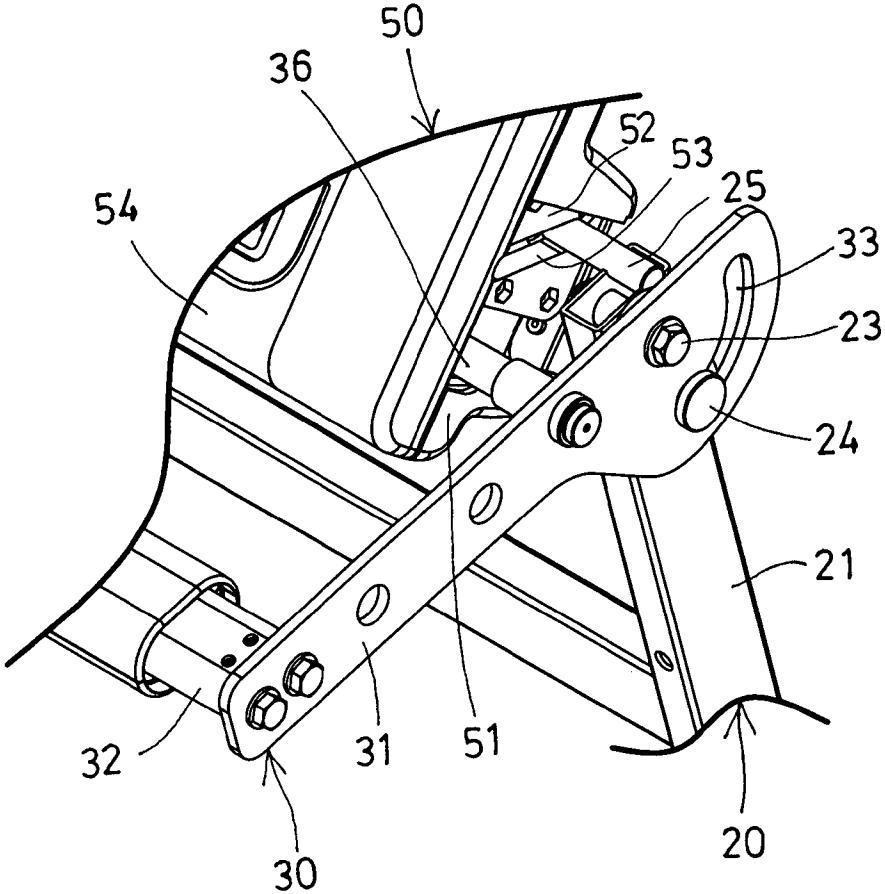
Figure 5:
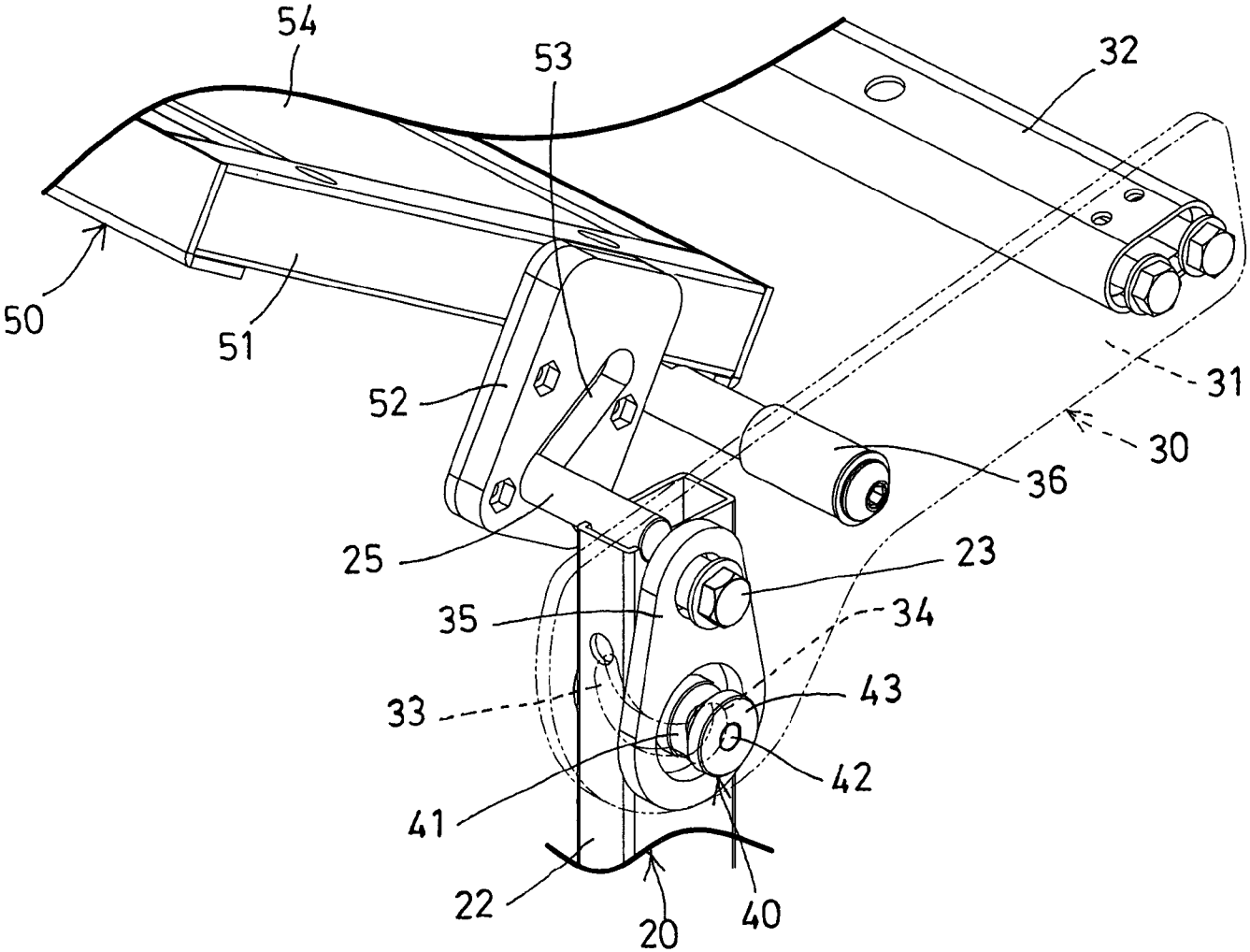
FIGS. 5, 6 are enlarged partial perspective views illustrating the other side portion of the control console or control panel or control device for the treadmill.

It is preferable that two pads or spacers or gaskets 35 are disposed in the inner portions of the arms 31 and disposed or engaged between the arms 31 and the beams 21, 22 of the support device 20 respectively (FIGS. 4-8) for suitably separating the arms 31 and the beams 21, 22 from each other, and/or for reinforcing the arms 31, or for reducing the friction between the arms 31 and the beams 21, 22 of the support device 20, and for allowing the arms 31 to be smoothly pivoted or rotated relative to the beams 21, 22 of the support device 20. It is preferable that the support device 20 includes a guide pin 24 attached to or extended from one of the beams 21 (FIGS. 3, 4) and slidably engaged in the curved slot 33 of the arm 31 for guiding the arm 31 to pivot or rotate relative to the beam 21 and also for limiting the arm 31 to pivot or rotate relative to the beam 21.

As shown in FIGS. 5-10, a latch device 40 includes a casing 41 attached or disposed or engaged in the other beam 22 (FIGS. 5, 7, 8), a button 42 slidably attached or disposed or engaged in the casing 41 and slidably engaged in the curved slot 33 of the arm 31, and a latch member 43 attached or secured to the button 42 and extended out of the casing 41, the latch member 43 includes an outer diameter greater than the inner diameter of the curved slot 33 of the respective arm 31 (FIG. 7), but equal to or slightly smaller or no greater than the inner diameter of the enlarged opening 34 of the arm 31 for allowing the latch member 43 to be selectively engaged into the opening 34 of the arm 31 (FIG. 8) and thus for latching the arm 31 to the other beam 22 and for maintaining the arm 31 at the unfolding or open or working position relative to the beam 22 as shown in FIGS. 1, 3-4, and 10.

Figure 8:
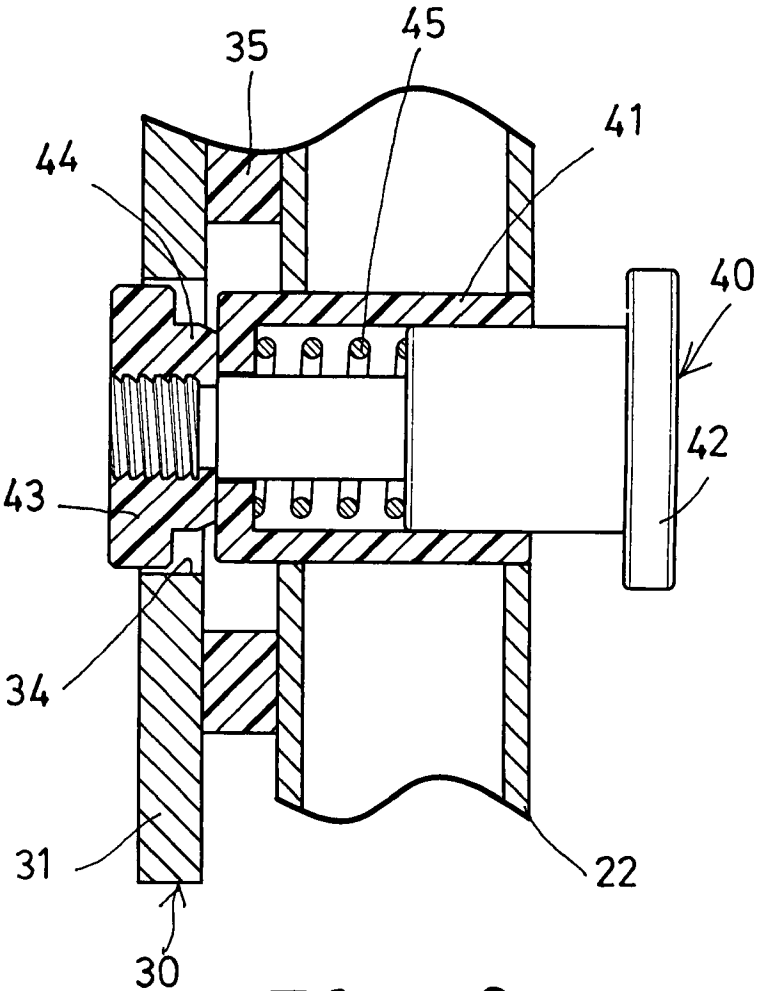
FIG. 8 is a partial cross sectional view similar to FIG. 7, illustrating the operation of the treadmill.
Figure 7:
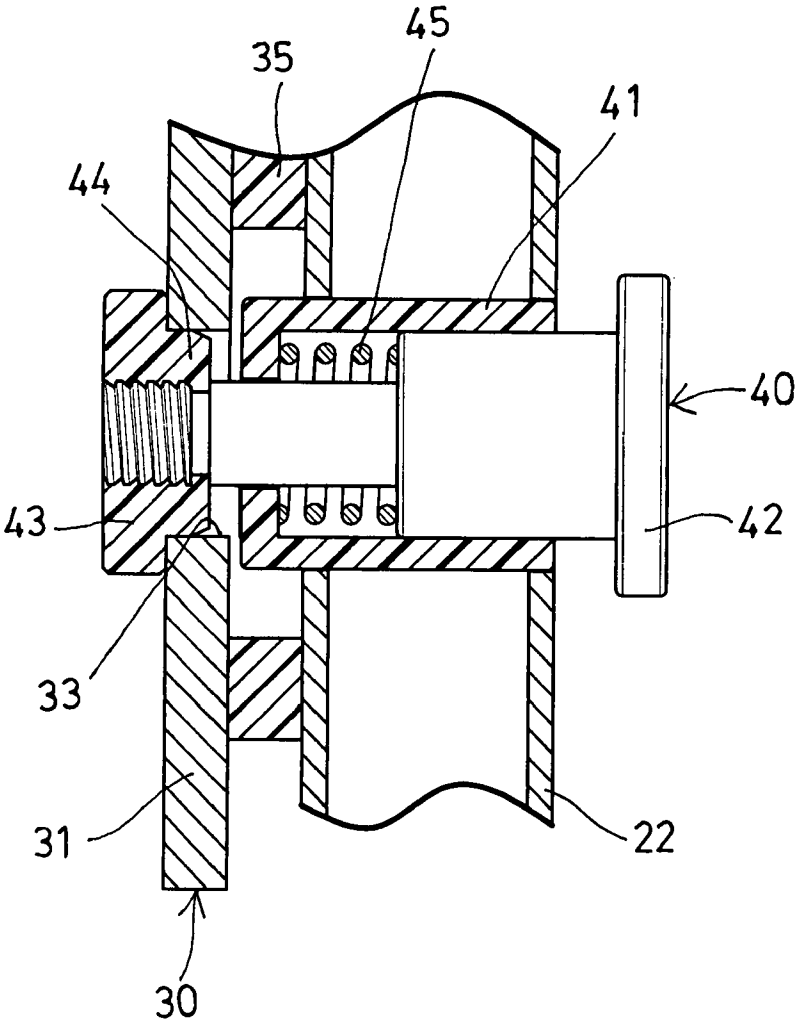
FIG. 7 is a partial cross sectional view of the treadmill taken along lines 7-7 of FIG. 6.

As best shown in FIGS. 7 and 8, the latch member 43 includes a bulge or swelling or protrusion 44 extended inwardly therefrom and having an outer diameter equal to or slightly smaller than the inner diameter of the curved slot 33 of the arm 31 for allowing the protrusion 44 of the latch member 43 to be slidably engaged into the curved slot 33 of the arm 31 and to guide the latch member 43 to smoothly slide relative to the arm 31. A spring biasing means or member 45 is disposed in the casing 41 and engaged with the button 42 for biasing the latch member 43 to selectively engage into the opening 34 of the arm 31 (FIG. 8) when the latch member 43 is aligned with the opening 34 of the arm 31 and for latching or securing the arm 31 to the beam 22 at the selected or required angular positions.

The control device 50 includes a housing or frame 51 pivotally or rotatably attached to the arms 31 with a pivot shaft 36 which may include one or two shaft segments 37 (FIGS. 9, 10) attached to or extended from the frame 51 and pivotally or rotatably attached to the arms 31 for pivotally or rotatably attaching or coupling the frame 51 to the arms 31 and for allowing the frame 51 to be pivoted or rotated relative to the arms 31 of the handle device 30, and includes one or more (such as two) ears or flaps 52 attached to or extended from the two side portions of the frame 51, and includes an inclined groove 53 formed in each of the flaps 52. The support device 20 further includes one or more (such as two) guide rods 25 disposed or secured on the beams 21, 22, such as disposed or secured on top of the beams 21, 22 for slidably engaging into the grooves 53 of the flaps 52 respectively (FIGS. 3, 5-6, 9-10) and for guiding the frame 51 to pivot or to rotate relative to the beams 21, 22 of the support device 20. A control panel 54 is attached to or supported on the frame 51 for showing the information of the treadmill.

Figure 6:
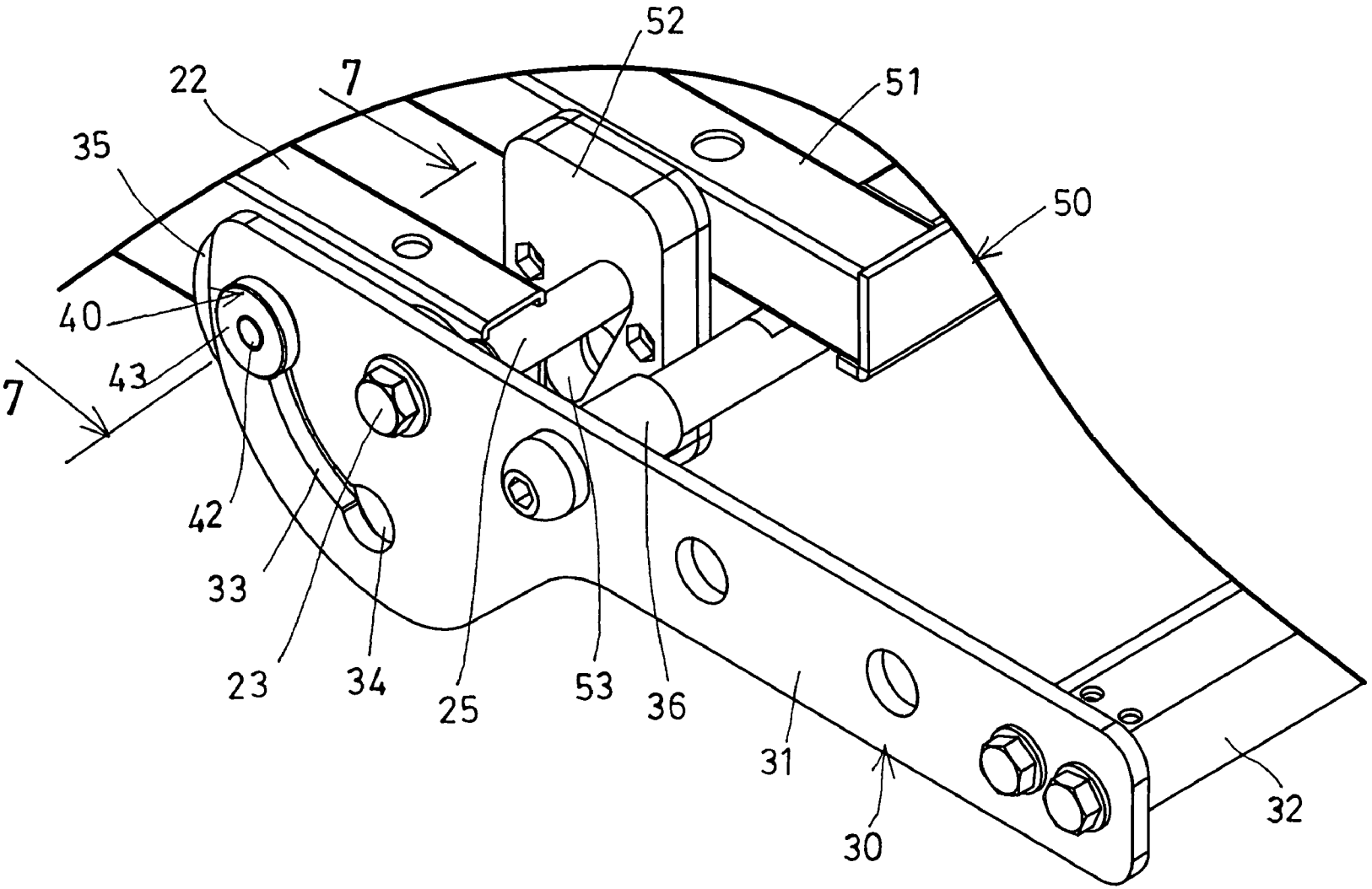

In operation, when the handle device 30 is pivoted or rotated relative to the beams 21, 22 of the support device 20 between the unfolding or open or working position as shown in FIGS. 1, 3-5 and 10 and the folding or close or storing position as shown in FIGS. 2 and 6, or when the arms 31 of the handle device 30 are moved or pivoted or rotated relative to the beams 21, 22 of the support device 20, the frame 51 and the pivot shaft 36 may also be caused to pivot or to rotate relative to the beams 21, 22 of the support device 20, and the grooves 53 of the flaps 52 are arranged to guide the frame 51 and the control panel 54 to pivot or to rotate relative to the beams 21, 22 of the support device 20 and the arms 31 of the handle device 30 between the unfolding or open or working position (FIGS. 1, 3-5 and 10) and the folding or close or storing position (FIGS. 2 and 6).

It is to be noted that the frame 51 of the control device 50 is shown to be pivotally or rotatably attached to the arms 31 with the pivot shaft 36 for allowing the frame 51 and the control panel 54 to be pivoted or rotated relative to the arms 31 of the handle device 30, and the frame 51 and the control panel 54 may also be tilted or inclined relative to the arms 31 of the handle device 30 and adjustably secured to the arms 31 of the handle device 30 at any suitable or selected or required angular positions with the other latching or locking means or devices (not shown), for allowing the control panel 54 to be easily seen by the shorter users, such as the children. The frame 51 and the control panel 54 may also be tilted or inclined or adjusted relative to the beams 21, 22 of the support device 20 with the arms 31 of the handle device 30.

It is further to be noted that the frames and the control panels of the control devices of the typical treadmills are normally solidly and fixedly attached or disposed or secured on top of the front support structure, and may not be tilted or adjusted relative to the front support structure to the other required angular positions such that some of the users, particularly the children may not suitably see or watch the control console or control panel or control device particularly while jogging or running on the endless belt of the tread base.

Accordingly, the treadmill in accordance with the present invention includes a control console or control panel or control device pivotally or adjustably attached to or disposed on a front support structure with a handle device and tiltable or adjustable relative to the front support structure to any required angular position.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill comprising:

a tread base, an endless belt rotatably attached to said tread base a support device disposed on said tread base, a handle device including two arms pivotally attached to said support device with an axle for allowing said handle device to be pivoted relative to said support device between a working position and a storing position, a hand grip secured between said arms, and a control device disposed between said arms; wherein said handle device includes a curved slot formed in one of said arms and formed around said axle, and said support device includes a latch device slidably engaged with said curved slot of said arm for latching said arm to said support device at selected angular positions.

2. The treadmill as claimed in claim 1, wherein said control device includes a frame pivotally attached to said arms with a pivot shaft for allowing said frame to be pivoted relative to said arms of said handle device.

3. The treadmill as claimed in claim 1, wherein said control device includes a flap attached to said frame and having a groove formed in said flap, and said support device includes a guide rod slidably engaged into said groove of said flap for guiding said frame to pivot relative to said support device.

4. The treadmill as claimed in claim 3, wherein said support device includes two beams, and said guide rod is disposed on one of said beams.

5. The treadmill as claimed in claim 4, wherein said support device includes a gasket disposed between said arm and said beam.

6. The treadmill as claimed in claim 4, wherein said handle device includes a curved slot formed in one of said arms and formed around said axle, and said support device includes a guide pin slidably engaged into said curved slot of said arm for guiding said arm to pivot relative to said beam and for limiting said arm to pivot relative to said beam.

7. The treadmill as claimed in claim 6, wherein said support device includes two beams, and said guide pin is disposed one of said beams.

8. The treadmill as claimed in claim 1, wherein said arm includes an enlarged opening formed in one end of said curved slot and having an inner diameter greater than that of said curved slot of said arm, said latch device includes a latch member having an outer diameter greater than the inner diameter of said curved slot of said arm but no greater than the inner diameter of said opening of said arm for allowing said latch member to be engaged into said opening of said arm and for latching said arm to said handle device.

9. The treadmill as claimed in claim 8, wherein said support device includes two beams, and said latch device includes a casing attached to one of said beams, a button slidably engaged in said casing and secured to said latch member, and means for biasing said latch member to engage into said opening of said arm.

10. The treadmill as claimed in claim 9, wherein said support device includes a gasket disposed between said arm and said beam.

* * * * *